US009049888B2

(12) United States Patent
Eubank

(10) Patent No.: US 9,049,888 B2
(45) Date of Patent: Jun. 9, 2015

(54) DISPOSABLE BEACH ASHTRAY

(76) Inventor: Marty Gene Eubank, Newport News, VA (US)

( * ) Notice: Subject to any disclaimer, the term of this patent is extended or adjusted under 35 U.S.C. 154(b) by 901 days.

(21) Appl. No.: 13/200,836

(22) Filed: Oct. 3, 2011

(65) Prior Publication Data

US 2013/0081641 A1 Apr. 4, 2013

(51) Int. Cl.
*A24F 19/14* (2006.01)
*A24F 19/00* (2006.01)

(52) U.S. Cl.
CPC ..... *A24F 19/005* (2013.01); *A24F 19/0071* (2013.01); *A24F 19/0092* (2013.01); *A24F 19/145* (2013.01)

(58) Field of Classification Search
CPC . A24F 19/0028; A24F 19/145; A24F 19/005; A24F 19/0092; A24F 19/0071
USPC ..... 131/235.1, 231, 240.1, 241, 260
See application file for complete search history.

(56) References Cited

U.S. PATENT DOCUMENTS 1,829,844 A * 11/1931 Altmayer ..... 131/235.1
2,830,817 A * 4/1958 Schoberl ..... 473/579
5,122,014 A * 6/1992 Genfan ..... 405/244
5,647,381 A * 7/1997 Rainer ..... 131/235.1
5,853,340 A * 12/1998 Willis ..... 473/579
2004/0074787 A1 * 4/2004 Donos ..... 206/120

FOREIGN PATENT DOCUMENTS

DE 297 04 658 * 6/1997
FR 28 19998 * 5/2001
FR 10 01778 * 4/2010
WO WO 02/060284 * 8/2008

* cited by examiner

*Primary Examiner* — Richard Crispino
*Assistant Examiner* — Dionne Walls Mayes

(57) ABSTRACT

An ashtray having a conical shaped wall. The ashtray is used in sandy environments. The wall consists of wall supports and a series of elongated blades along the length of the lower wall. The ashtray has an attached lid that snaps into the wall supports with an opening to receive extinguished cigarettes. When the ashtray is inserted into the substrate, the external pressure exerted against the wall causes the blades to open. The ashtray is then twisted into the substrate causing the receptacle to fill with sand thereby covering the lid. Cigarettes are extinguished in the substrate. Once the upper surface is filled with waste, the ashtray is lifted and the substrate easily exits the wall cutouts and bottom opening. The butts are easily pushed through the lid. The ashtray can then be reinserted into the substrate covering the waste and providing for a fresh surface to receive additional cigarettes.

7 Claims, 4 Drawing Sheets

DISPOSABLE BEACH ASHTRAY

CROSS-REFERENCE TO RELATED APPLICATIONS

Not Applicable

BACKGROUND OF THE INVENTION

1. Field of the Invention

This invention relates to a disposable or reusable ashtray for use in sandy environments such as a beach that will interact with the sandy substrate to extinguish a cigarette and provide for a means to repeatedly offer a fresh extinguishing surface while storing waste until disposal.

2. Description of the Prior Art

Smoking is an enjoyable pastime for many individuals, especially at outside recreational areas such as the shores and beaches along oceans, rivers, and bays. As the sandy substrate typically found along these waterfront areas is not combustible and serves as an excellent extinguishing medium, many smokers extinguish their cigarettes directly into the sandy substrate. Unfortunately, it is much too often that individuals do not remove this litter from the shores prior to vacating the area.

Heretofore there have been a few beach ashtrays proposed or commercialized to attempt to encourage smokers along the beaches to use such product to help maintain the cleanliness of the shores and to protect the marine environment and animals from the hazards of the toxic chemicals contained within the discarded cigarette butts.

One such ashtray as shown in U.S. Pat. No. 5,647,381 to Rainer, 1997 Jul. 15, incorporates a large radial flange designed to limit the distance the ashtray enters into the substrate and to support and protect the cigarette from contact and contamination with the sand or soil. Thus the filter end of the cigarette rest on the flange that would be at the same level as the surface of the sandy substrate. As the filter end is typically moist from continuous placement in the smokers mouth, and as it is a normal environmental condition to encounter sufficient wind at a beach or shore to blow the sandy substrate along the beach at ground level, the filter could easily become contaminated with sand or grit causing an unpleasant transfer of this sand or grit into the smokers mouth.

Rainer's flange is also designed to add limited stability to the ashtray to prevent the ashtray from tipping over and spilling the extinguished cigarettes into the environment and to provide for a stop means to limit the insertion of the ashtray into the supporting substrate. However, since the floor of the Rainer's ashtray is inserted just below the surface of the substrate, and whereby the center of gravity for Rainer's ashtray is above the surface of the substrate, Rainer's ashtray does not provide substantial stability or means to securely anchor the ashtray into the substrate. Moreover, Rainer does not provide for a lid mechanism to secure waste inside of the receptacle. Additionally, it is very common to encounter loose sandy substrate along a beach and whereby it is normal to encounter continuous human activity at close proximity to where a smoker is sitting or lying, there exist a higher probability that the ashtray would be easily tipped over thereby spilling the toxic cigarette remains and tobacco product into the environment. Rainer's ashtray is also given to easily spilling the waste contents into the environment as the smoker walks to the nearest waste disposal area to empty the ashtray as there is no means to secure the waste inside the ashtray.

Rainer's design will also cause the ashtray to continue to fill with extinguished cigarettes until the receptacle becomes full. This can become unsightly and emit unpleasant stale odors that are offending to others in the near vicinity. Once the extinguishing surface of the ashtray is full of waste, the ashtray has no means to automatically cover stale smelling cigarette butts with sand and provide a fresh extinguishing surface. The smoker would be required to manually fill ashtray with additional sand causing ones hands to become sandy and gritty. If Rainer's ashtray was to be lifted from the substrate surface to allow the sand to exit the receptacle and then reinserted into the substrate, the sand enters the ashtray from the bottom openings and would cause the extinguished cigarettes to remain on the top surface of the sand. Therefore, there is no convenient means provided to cause the cigarette butts to be buried or to provide the smoker a fresh extinguishing surface.

Another type of beach ashtray design is shown in the patent application publication US 2004/0074787 A1, by Donos, 2004 Apr. 22, whereas the ashtray is made of cardboard or similar material that has been scored or printed with fold lines requiring the smoker to fold and construct the ashtray prior to use. It also requires that one or more panels of this construction be glued or otherwise secured to itself thus requiring ample time for the glue to harden prior to use. Therefore, because this ashtray requires construction prior to use, it is not conducive for use in a dispensing unit for purposes of providing a disposable ashtray along a beach or shore access or entry point. Additionally, because this ashtray would be constructed with a cardboard like material and because there is no means provided for the ashtray to easily dig into compact or wet substrate, it would be subject to a very high center of gravity from the surface of the substrate where it is inserted and could be easily tipped over spilling the toxic cigarette remains into the environment while the lid remains in an open position during use of the ashtray.

Yet another type of cardboard postcard sized beach ashtray has been commercialized that also uses scored or printed fold lines and requires the smoker to assemble prior to use. This ashtray is designed for promotional purposes to print advertisements on a postcard size cardboard or similar material and handed out along a beachfront area. This ashtray has no lid or means to secure waste until disposal and is given to be easily tipped over or even simply accidently buried in loose sandy substrate due to its small size. This ashtray can be quickly filled with discarded cigarette butts due to its size limitation. The postcard size ashtray does not provide for a means to automatically cover stale smelling butts with sand or provide a fresh extinguishing surface thus can quickly become unsightly and emit stale odors that are offensive to others in the near vicinity. If the sandy substrate is compact or wet, the ashtray could not dig into the supporting substrate due to being constructed with cardboard like material causing it to be unstable and subject to easily tipping over. Additionally, due to its small size it would be very limited as to the debt the ashtray could be inserted into the substrate. This design provides for a higher probability that the paper-like ashtray could be left on the beach after use and thus further polluting the environment. Furthermore, the overall commercialized appearance of this promotional postcard ashtray lends to the look of creating more unwanted debris on the beach. This ashtray is designed with the specific purpose of being used as a promotional postcard size billboard. It is the manufacturer's desire for the purchaser of the postcards to hand out the material to smokers on the beach for advertising purposes. This could result in the disbursement of unwanted solicitation material to smokers and nonsmokers and further increasing the probability that the ashtray would be discarded or left on beach as trash.

Other versions of a beach ashtray that have been commercialized providing for a basic cone shaped receptacle with a pointed end to be inserted partially into the sandy substrate with an attached lid. This type of design requires the smoker to first partially fill the ashtray with sand causing ones hands to become sandy and gritty. Or a closely related version to this design has a very small opening at the bottom of the cone shaped receptacle with a very limited perforated floor providing for several small openings for sand to enter and exit the receptacle. This design would provide for a very limited amount of sand to enter the ashtray receptacle when pushed into the substrate due to the nominal opening area at the bottom of the ashtray. Also, the ashtray could easily become clogged with cigarette butts and waste when removing the ashtray from the substrate for disposal. Thus the substrate could become trapped in the receptacle upon disposal adding significant unnecessary weight to the waste disposal units and also unwontedly removing sand from the beach area. This design will also cause the ashtray to continue to fill with extinguished cigarettes until the ashtray becomes full. This can become unsightly and emit unpleasant stale odors that are offending to others in the near vicinity and offers no means to provide the smoker with a fresh extinguishing surface. This design does not provide for a means to dig into the substrate if the substrate is compact causing it to be easily tipped over and spilling the waste into the environment. Additionally this design does not provide for a means for a beach attendant to easily retrieve ashtrays that have been left on the shores and have not been discarded or returned as desired.

Most smokers therefore, would desire a light weight durable beach ashtray that could be disposed of after use, or retained for future use, that would easily be inserted into the sandy substrate and not given to easily tipping over or prone to spilling the waste contents until such time as disposal. In addition, it would be desired to have an easy means to store previous extinguished cigarettes while covering the stale smelling waste with substrate and simultaneously providing a smoker with a fresh extinguishing surface to receive additional cigarettes.

SUMMARY OF THE INVENTION

The present invention provides for compact personal ashtray for use in outdoor sandy environments such as a beach or other sandy areas where persons frequent for relaxation purposes. Many individuals enjoy smoking while at the beach and extinguish their cigarettes directly into the surrounding sand where the individual is sitting or lying. Many smokers leave their cigarette waste behind when leaving the area simply because there was not a convenient way for them to pick up and carry the cigarette butts off the beach. It is also a very common misconception that cigarette butts quickly biodegrade. Not only does the cigarette litter present an unsightly and trashy appearance to the shores and beaches of the world's oceans and waterways, the cigarette remains contain toxic chemicals proven to be hazardous to the environment and to many marine animals.

Although cigarette filters have the appearance of white cotton, these filters are made of thin plastic fibers called cellulose acetate that can take up to fifteen (15) years to decompose. Each year, it is estimated that trillions of cigarette butts enter into our environment from discarded waste. Cigarettes may contain over 4000 chemicals including fifty-one (51) chemicals that are known to be carcinogenic. Cigarette butts contain chemicals such as tar, cadmium, arsenic, formaldehyde, lead, hydrogen cyanide, carbon monoxide, nitrogen oxide, ammonia, and other known toxins. These toxic chemicals are leached into the water systems along the shores and present a hazard to the marine environment. Cigarette butts can poison and even kill marine wildlife if ingested.

It is therefore the purpose of the present invention to provide an ashtray that can be easily and conveniently used on a beach and can be manufactured cheaply enough to be considered disposable, however durable enough to be used repeatedly if desired. The ashtray can be easily inserted into the sand in a downward twisting motion to cause the ashtray to partially fill with sand by means of a series of uniquely designed blades incised into the ashtray's outer wall that has been formed by an absence of material, or a cutout, during the manufacture process. The wall blades automatically open when the ashtray is inserted into the sand and then channel the surrounding sand into the ashtray when the ashtray is momentarily twisted into the supporting substrate. The wall blades automatically close when the ashtray is lifted from the substrate to secure the waste inside the receptacle. The sand and ash easily exit the ashtray through the openings forming the wall blades and the bottom opening of the ashtray. The bottom opening forms a series of blades at the bottom of the ashtray that loosen compact substrate and allows for easy insertion of the ashtray into the substrate.

The invention provides a lid that allows cigarette butts to easily be pushed through the lid opening and into the lower portion of the receptacle. The lid is snapped into the lower receptacle and is covered with sand when the ashtray is inserted and twisted into the supporting substrate. The sand that is confined within the ashtray's inner receptacle is then used to extinguish the smoker's cigarettes. When the ashtray's upper receptacle begins to fill with stale smelling and unsightly butts, the ashtray can be lifted to allow the sand to exit the receptacle. The butts are easily pushed through the lid opening into the lower receptacle and the ashtray can then be reinserted in the substrate and again twisted to cause the ashtray to partially fill with sand and thereby offering the smoker a fresh extinguishing surface while simultaneously covering the stale smelling cigarette butts. This process can be repeated several times over as needed.

The ashtray is also designed to allow for the insertion of a trash retrieval rod to allow a beach attendant an easy means to quickly and efficiently pick up ashtrays left on the beach. The rod is inserted down through the lid opening through the middle of the receptacle and out the bottom opening. The flexible tabs that form the lid opening and bottom opening grab the retrieval rod to allow the ashtray to be lifted from the beach without requiring the attendant to bend over to pickup the ashtray. This process can be repeated multiple times thereby causing the ashtrays to stack one upon the other and onto the retrieval rod for easy disposal or recycle.

Accordingly several objects and advantages of my invention are as follows: It is one primary object of the invention to provide for a nominal material requirement used during the production of the ashtray to reduce manufacture cost sufficiently enough to utilize the ashtray as a disposable cigarette waste receptacle while being substantially durable enough to be reused many times over if so desired. The invention could be easily and cheaply manufactured using an Injection Molding production method using inexpensive resins. In addition, the invention is designed as such to manufacture the ashtray with very thin walls that includes a plurality of material cutouts that form the wall blades and a lid design that will minimize material cost for production.

It is another primary object of the invention that the ashtray is designed with a conical shape that would allow for compact storage of multiple units by means of stacking the receptacles on top of each other with the lid in the open position. This would allow for the storage and easy dispensing of the disposable ashtray in a tubular or similar type dispensing unit that could be strategically located at or near beach access points.

Additionally, the conical shape of the present invention provides for a major advantage over prior art in that it eliminates the need for a large outwardly projecting flange surrounding the lower perimeter of the receptacle to stabilize and support the ashtray on the surface of the supporting substrate. The present invention provides for a means to substantially insert the ashtray down into the substrate thus causing the center of gravity of the ashtray to be well below the surface of the supporting substrate and thereby securely anchoring the ashtray into the substrate to prevent accidental tipping.

Yet another object and advantage of the present inventions is that the ashtray provides a means to interact and automatically fill with the natural sand substrate, an excellent medium to extinguish cigarettes. When the ashtray is inserted and momentarily twisted into the substrate, the wall blades cause the lower receptacle to automatically fill with sand eliminating the need to have the smoker fill the ashtray by hand thereby causing ones hands to become gritty. By simply twisting the ashtray into the surface of the sandy substrate, a confined area of substrate is formed within the receptacle of the ashtray.

The uniquely designed wall blade made by means of a simple cutout formed during the manufacturing process provides for a thin flexible upper and lower blade hinge that attaches the blade to the ashtray. Accordingly, it is a principle object of the invention to provide a means for the wall blades of the ashtray to automatically open when the ashtray is inserted into the substrate and to automatically close when the ashtray is removed from the substrate thereby securing the waste inside the receptacle. Upon leaving the beach or shore, the smoker simply removes the ashtray from the substrate and the cigarette butts and large particles of waste are retained and secured in the lower receptacle area of the ashtray until such time as disposal. The cigarette carbon ash is biocompatible and not toxic to the environment and falls harmlessly through the wall cutouts and bottom opening along with the substrate leaving the toxic cigarette filters and residual tobacco product within the lower receptacle to be safely disposed.

Therefore, it is another principle object of the invention to automatically separate cigarette filters, butts, and large particles of waste from the substrate that has automatically entered the ashtray to use as an extinguishing medium upon such time as the waste can be property discarded.

Conventional personal ashtray designs present an unsightly appearance and emit stale smelling offending odors as they continue to fill with extinguished cigarettes. As such, it is another principal object and advantage of this novel invention to provide for a very compact personal beach ashtray that provides a means for the smoker to repeatedly receive a fresh extinguishing surface and to automatically cover the extinguished cigarettes thereby suppressing all odors.

It is a further object of the invention to provide for an attached lid that is snapped internally into the ashtray just below the top of the receptacle's wall supports. The lid has a center opening with flexible tabs along the inner radius of the lid thus providing for a minimum material requirement for manufacture and a means to secure cigarette waste until such time as disposal preventing accidental spillage of cigarette waste back into the environment. The lid can be easily unsnapped from the receptacle's wall supports to open the ashtray in order to empty to waste contents of the ashtray into a waste disposal receptacle.

Additionally, the internal lid is dual functioning in that is serves as a lid to secure waste inside the receptacle from accidental spillage and that it also serves as a blade stop means. Therefore, it is a further object of the invention to provide for a lid that will automatically limit the distance the wall blades may open thus maintaining the optimal angle of attack the blades have against the surrounding substrate to quickly fill the lower receptacle with sand when twisted into the substrate. The lid also provides for a convenience in that once snapped into place, there is no flipping of the lid open and closed to deposit cigarette ash or butts into the ashtray.

Another major advantage the invention offers for use in compact or wet substrate is the bottom digger blades incorporated into a uniquely designed bottom opening. The digger blades will easily loosen compact substrate as the astray is twisted into the substrate allowing the loosened sand to be easily channeled into the receptacle by means of the wall blades.

Yet another major advantage and object of the invention is that both the lid design utilizing a center opening formed by a plurality of flexible tabs and also the bottom opening of the ashtray formed by a plurality of slightly flexible digger blades provide for the means to easily and efficiently retrieve multiple ashtrays from a beach that is maintained by a beach attendant. By the simple use of a trash retrieval rod that has a diameter slightly larger than that of the lid's opening and that of the bottom opening, such retrieval rod could be inserted directly through the center opening and down through the bottom opening of the ashtray to easily pick up the receptacle without the attendant having to bend over to remove the ashtray from the substrate. This process could be continuously repeated thereby stacking the ashtrays upon each other and onto the retrieval rod to dispose of multiple ashtrays at once or retain the ashtrays for subsequent use.

An additional advantage of the invention is that the burning cigarette is held firmly in a recess when not being held by the smoker that is well above the surface of the substrate to protect it from being contaminated with sand or grit that could be blown along the surface of the beach or shore.

Further objects and advantages of the present invention will become apparent from a consideration of the following specification and drawings.

BRIEF DESCRIPTION OF THE SEVERAL VIEWS OF THE DRAWING

For a better understanding of the invention, reference is made to the following drawings and accompanying descriptions to show designated reference characters to the same or similar parts throughout several views, and wherein.

DRAWING REFERENCE NUMERALS

2 Sandy Substrate
4 Cigarette
6 Cigarette Buts
8 Ash
10 Ashtray
12 Receptacle
14 Upper portion of Wall
16 Lower Wall Assembly
18 Wall Cutouts
20 Recesses
20*a* Bottom Recess Distance
20*b* Top Recess Distance
22 Wall Supports
24 Lid Snap Recess
26 Bottom Digger Tool
28 Bottom Digger Blades
30 Bottom Openings
32 Wall Blade
32*a* Leading Edge of 32
32*b* Trailing Edge of 32
34 Upper Blade Hinge of 32
36 Lower Blade Hinge of 32
38 Lid
38*a* Outer Edge of 38
40 Flexible Lid Tab
42 Lid Opening
44 Lid Snap Tab
46 Lid Attachment Strap
48*a* Lid Attachment Hinge
48*b* Wall Lid Attachment Hinge
49 Lid Strap Recess
50 Diameter of 14
52 Retrieval Rod

DETAILED DESCRIPTION OF THE INVENTION

Figure 1:
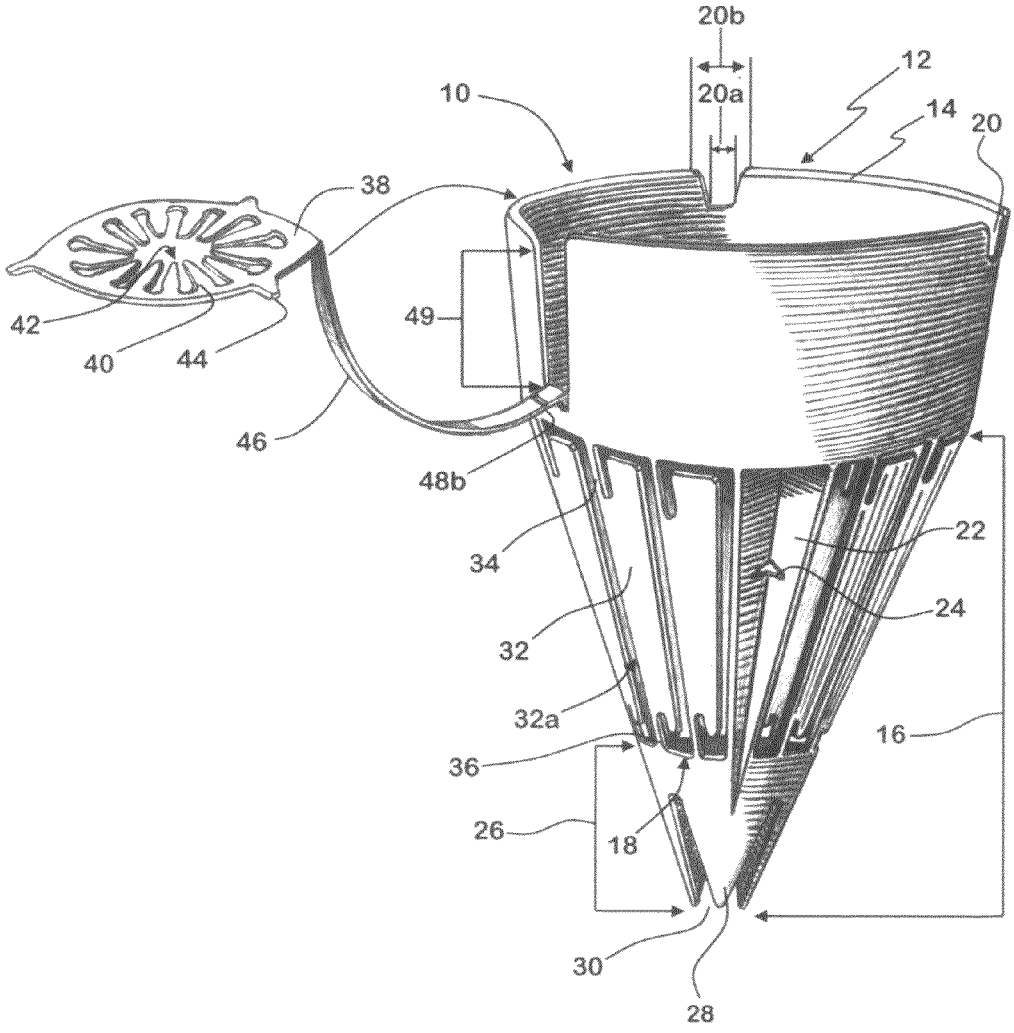
FIG. 1 is a perspective view of the invention shown with the attached lid in the open position.
Figure 2:
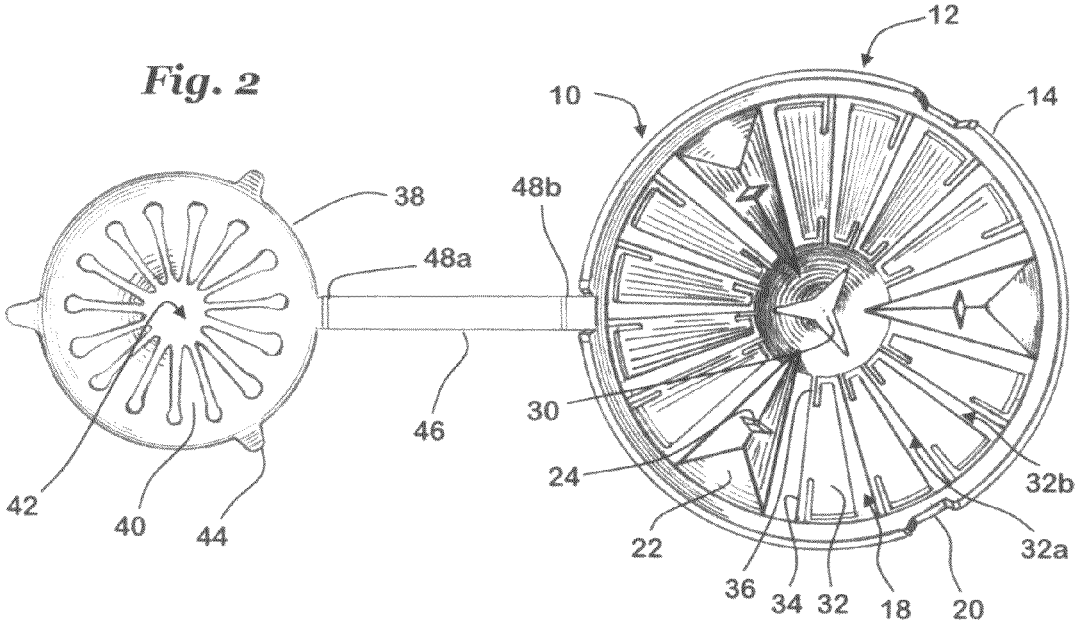
FIG. 2 is a top plan view of the invention showing the attached lid in an open position and the wall blades in the closed position.
Figure 3:
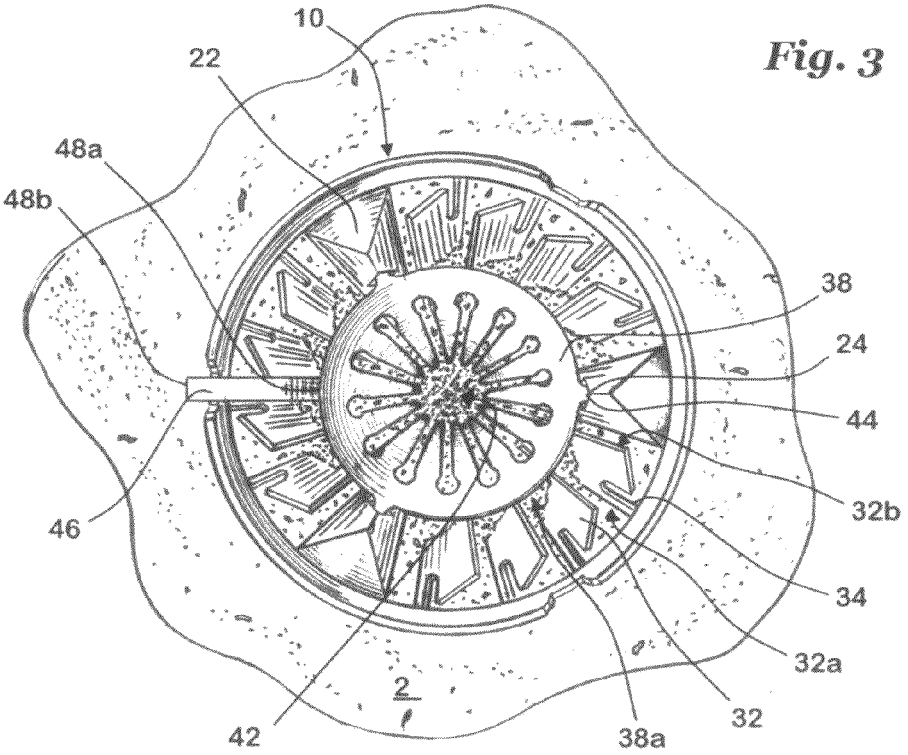
FIG. 3 shows an environmental top plan view as the invention is initially inserted into the substrate showing the wall blades in the open position with the attached lid in a closed position.
Figure 4:
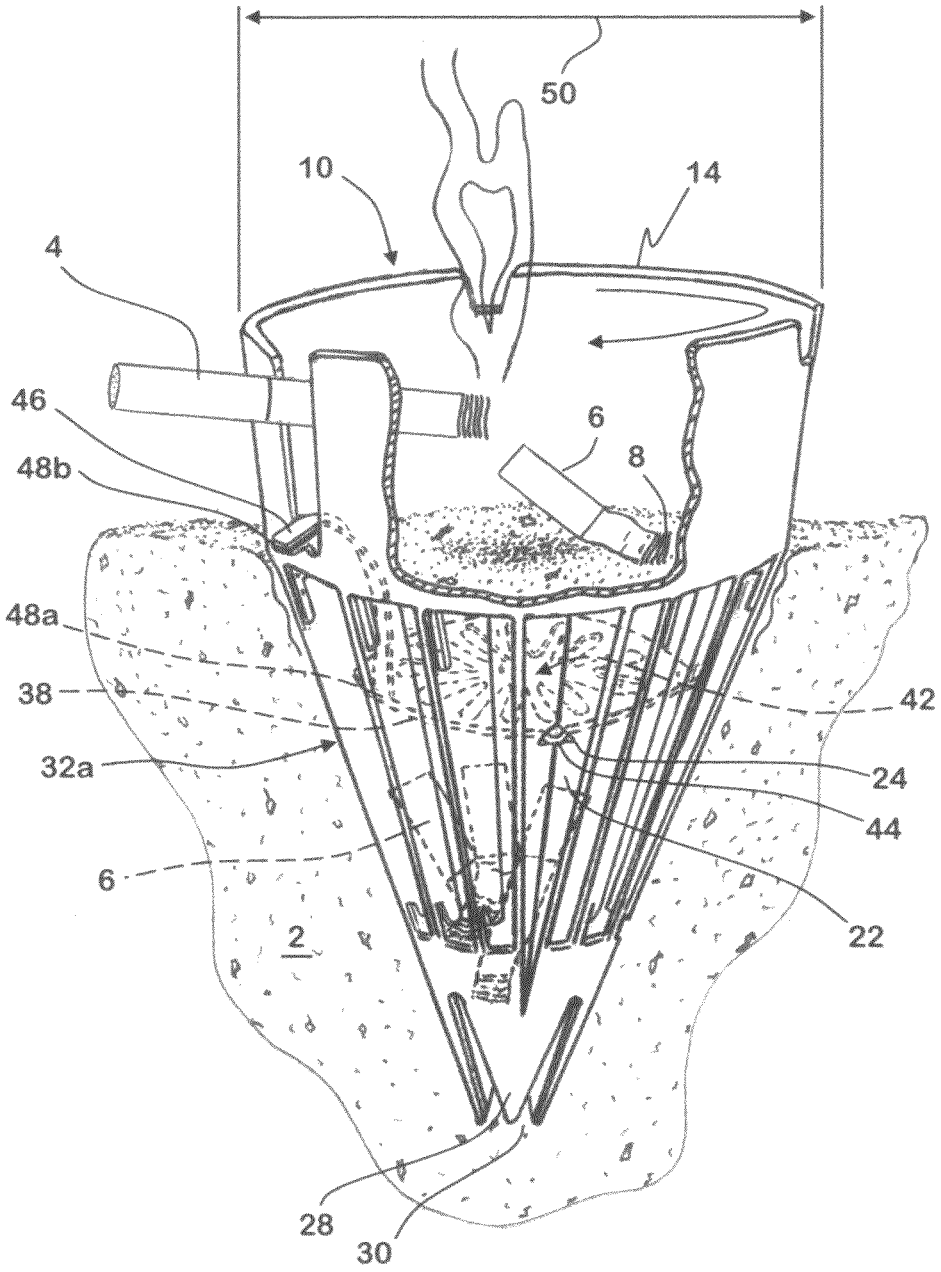
FIG. 4 is an environmental perspective view shown partially in cross section after the invention has been inserted and twisted into the substrate causing the lower section of the receptacle to be filled with the surrounding substrate and covering the lid with the substrate.

Turning to FIG. 1 of the drawings, the ashtray 10 comprises a receptacle 12 defined within the upper wall 14 and within the lower wall assembly 16. The upper wall 14 is of a generally frustoconical shape with the upper diameter 50 of the upper wall 14 is of a slightly greater diameter in relation to the lower diameter of upper wall 14 as shown in FIG. 4 at the point where the lower wall assembly 16 is joined to the upper wall 14 by the upper blade hinge 34 and the top of the wall supports 22 as best shown in FIG. 1. A lid strap recess 49 is also formed therein along the upper wall 14 as to allow the lid attachment strap 46 to enter the receptacle 12 by bending upon the upper wall lid attachment hinge 48*b* as shown in FIG. 1 and in FIG. 3. The lid 38 is attached to the lid attachment strap 46 by means of the lid attachment hinge 48*a* as best shown in FIG. 2. The lid attachment hinges 48*a* and 48*b* are formed as such to allow the lid 38 to rotate into the receptacle area 12 of the ashtray 10 and lock into a horizontal position by snapping the lid snap tabs 44 into the lid snap recesses 24 formed into the wall supports 22 just below the top of the lower wall assembly 16 as best shown in FIG. 2. Also shown in FIG. 2 and FIG. 1 is the lid opening 42 formed by a plurality of flexible lid tabs 40 formed along the inner radius of the lid 38. Also shown in FIG. 1 and FIG. 4, are additional recesses or reliefs 20 formed therein along the top of upper wall 14 whereas the distance at the top of the recess 20*b* is of a slightly larger diameter that that of a standard size cigarette 4 and the distance at the bottom of the recess 20*a* is of a slightly smaller diameter of that of a standard size cigarette 4 as to cause the recess 20 or 49 to pinch and securely hold a cigarette 4 when inserted into the recess 20 or 49 as shown in FIG. 4.

The lower wall assembly 16 is of a generally conical shape comprised of the wall supports 22, the wall blades 32, and the bottom digger tool 26. The wall supports 22 join the upper wall 14 and the bottom digger tool 26 as best shown in FIG. 1. The wall supports 22 are molded as such as to provide a rigid vertical right angle beam with the angled edge of the wall support 22 being directed towards the center of the receptacle 12 as best shown in FIG. 2 and FIG. 3. The wall supports 22 taper down its length to form a point at the bottom of the wall supports 22 where it is joined to the bottom digger tool 26 as best shown in FIG. 1. The wall blade 32 is formed by means of a wall cutout 18 or absence of material (see FIG. 1 and FIG. 2) during the manufacturing process thereby forming the wall blade 32 and the upper and lower blade hinges 34 and 36. Both the upper and lower blade hinges 34 and 36, having been manufactured with a flexible plastic resin, are of sufficient length and are sufficiently narrow in width to cause the wall blades 32 to easily be turned and opened towards the center of the receptacle 12 as shown in FIG. 3. The wall supports 22 and the lower blade hinges 36 attach the bottom digger tool 26 to the ashtray 10.

FIG. 1 and FIG. 2 show ashtray 10 with the lid 38 in an open position and with the wall blades 32 in the normal closed position prior to inserting the ashtray 10 into the substrate 2. FIG. 3 shows ashtray 10 in its environment after being pushed partially into the substrate 2 with the lid 38 in the closed position. By pushing ashtray 10 partially into the substrate 2, the external pressure of the substrate 2 exerted against the wall blades 32 causes the upper and lower blade hinges 34 and 36 to twist outwardly from the center of the receptacle 12 allowing the wall blades 32 to partially open with the trailing edge 32*b* of 32 moving inwardly towards the center of the receptacle 12. The blades 32 open with the leading edge 32*a* angled toward the outer substrate 2. By simply twisting ashtray 10 in the direction of the leading edge of the blades 32*a*, the wall blades 32 open fully with the trailing edge of the blade 32*b* pressing against the outer edge of the lid 38 and thereby creating a stop means to prevent the wall blades 32 from opening further thus maintaining the optimal angle of attack relative to the direction of the leading edge 32*a* of 32 against the external substrate 2 as shown in FIG. 3.

By applying a downward force and momentarily twisting the ashtray 10 into the substrate 2, the area of the lower receptacle 12 as defined by the length of the lower wall assembly 16 is quickly filled with the sandy substrate 2 and thereby covering the lid 38 that is in the closed position as shown in FIG. 4. As the ashtray 10 is twisted, the leading edges 32*a* of the blades 32 cuts into the surrounding substrate 2 as the blades 32 channel the substrate 2 into the receptacle 12 and automatically causes the receptacle 12 to substantially fill with the sandy substrate 2. Therefore the ashtray 10 has provided a means to automatically fill the receptacle 12 with the surrounding substrate 2 without requiring the smoker (not shown) to manually fill the ashtray 10 by hand causing ones hands to become sandy or gritty. In addition, the ashtray 10 has provided for a confined surface of sandy substrate 2 to extinguish cigarettes 4 and receive cigarette butts 6, ash 8, and other large particles of waste. The surface of the substrate 2 within the confined area of the receptacle 12 covers the lid 38 and protects it from being exposed to excessive heat and becoming damaged by the burning end of the cigarette 4 while being extinguished as shown in FIG. 4.

As clearly shown in FIG. 4, the lower area of the receptacle 12 as defined by the length of the lower wall assembly 16 is securely anchored down into the supporting substrate 2. The invention thereby creates a very low center of gravity relative to the length of the upper wall 14 that remains above the surface of the substrate 2 in comparison to the lower area of the receptacle 12 as defined by the length of the lower wall assembly 16 that remains below the surface of the substrate 2. Therefore the invention has provided for a means to securely anchor the ashtray 10 down into the supporting substrate 2 to prevent accidental tipping of the ashtray 10 and spilling the waste contents held temporarily within the upper wall 14 into the surrounding environment.

Once the receptacle 12 begins to fill with extinguished cigarette butts 6 and ash 8 and therefore becoming unsightly and emitting stale offending odors, the ashtray 10 can be easily lifted from the substrate 2 and lightly shaken to allow the substrate 2 to easily exit the receptacle 12 through the bottom opening 30 and the lower wall cutouts 18. The cigarette butts 6 and other large particles of waste are easily pushed through the lid opening 42 into the lower receptacle 12. The lid opening 42 and the flexible lid tabs 40 provide for a means to easily receive the waste into the lower receptacle 12 and prevent the waste from spilling back into the environment if the ashtray 10 is tipped over or turned upside down. As the substrate 2 begins to exit the receptacle 12, the molecular memory of the upper and lower blade hinges 34 and 36 automatically causes the wall blades 32 to move to the closed position as shown in FIG. 1 and FIG. 2 and thereby preventing cigarette butts 6 and other large particles of waste from escaping. Therefore the ashtray 10 has provided for a means to automatically separate the substrate 2 and cigarette ash 8 from cigarette butts 6 and other large particles of waste. The cigarette ash 8 also exits the ashtray 10 however it has been reduced to carbon and is considered harmless and biocompatible with the environment.

The ashtray 10 can now be reinserted into the substrate 2 along with the previously extinguished cigarette butts 6 that are positioned at the bottom of the receptacle 12. By again applying a downward force and momentarily twisting the ashtray 10 in the direction of the leading edge 32*a* of the wall blade 32, the ashtray 10 will fill the lower area of the receptacle 12 with substrate 2 and thereby causing the previously extinguished cigarette butts 6 to become covered with substrate 2 thus eliminating the unsightliness and stale odor of the cigarette butts 6. Furthermore, the smoker has now been provided a fresh surface of substrate 2 to extinguish cigarettes 4 within the receptacle 12 and to receive additional cigarette butts 6 as shown in FIG. 4. This process can be repeated several times over as needed to receive a fresh extinguishing surface and cover stale smelling cigarette butts 6.

In the event that the substrate 2 encountered in an environment is compact and the ashtray 10 cannot be easily inserted into the supporting substrate 2, the bottom digger tool 26 shown in FIG. 1 and FIG. 4 is used to loosen the underlying substrate 2. As the ashtray 10 is twisted down into the substrate 2, the digger blades 28 easily loosen compact or wet substrate 2 to allow the ashtray 10 to be fully inserted into the environment.

Figure 5:
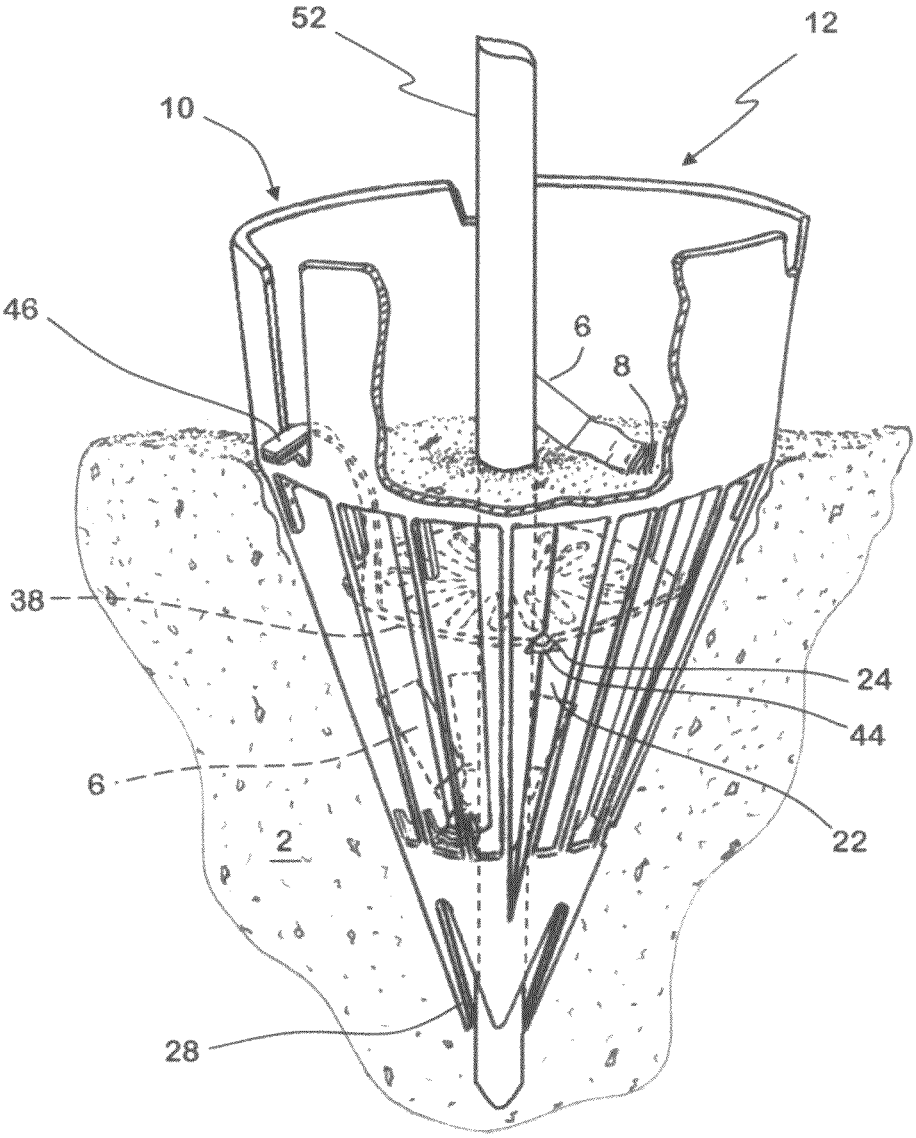
FIG. 5 shows an environmental perspective view shown partially in cross section reflecting a means for a trash retrieval rod to be inserted through the top lid opening of the invention and exiting through the bottom opening.

Many beaches and shores are maintained by a beach attendant or other hired workers to assist guest and help ensure the beaches are kept clean and free of debris. As such, the invention provides for a means to easily and efficiently retrieve multiple ashtrays 10 from the environment. As shown in FIG. 5, a simple retrieval rod 52 can be inserted through the middle of the receptacle 12 into the lid opening 42 and down through the bottom opening 30. By utilizing a retrieval rod 52 with a diameter slightly greater than that of the lid opening 42 and the bottom opening 30, such retrieval rod 52 could be inserted through the center of the receptacle 12 to easily retrieve the ashtray 10 without the attendant having to bend over to remove the ashtray 10 from the substrate 2. As the lid 38 is comprised of thin flexible tabs 40, the rod 52 can easily pass through the lid opening 42 engaging the lid tabs 40 to grip the rod 52 and maintain a vertical alignment with the rod 52 through the center of the receptacle 12. The rod 52 would then pass through the bottom opening 30 as defined by the area surrounding the bottom digger blades 28 (see FIG. 1, FIG. 2 and FIG. 3) and being that the bottom digger blades 28 are only slightly flexible, the digger blades 28 would grab and hold the rod 52 to easily lift the ashtray 10 from the surface of the beach. By continuously repeating this process, multiple ashtrays 10 could be stacked one upon the other thus causing the preceding ashtrays 10 to be pushed up the retrieval rod 52 as each additional ashtray 10 is retrieved and thereby providing a very efficient means to recover the ashtrays 10 for subsequent use or to dispose of multiple ashtrays 10 at once into a waste disposal area.

Thus it will be seen that ashtray 10 is perfectly suited for use in a sandy environment to interact with the supporting substrate 2 to automatically fill the receptacle 12 with substrate 2 in order to extinguish cigarettes 4 and to securely anchor the ashtray 10 into the substrate 2 while offering the smoker (not shown) a means to repeatedly receive a fresh extinguishing surface while covering stale smelling butts 6 until such time as disposal. Additionally, it will also be seen that the ashtray 10 provides for the means to automatically separate and store the cigarette butts 6 and other large particles of waste from the substrate 2 and to provide an efficient and easy means for the ashtray 10 to receive a retrieval rod 52 to facilitate the retrieval of multiple ashtrays 10 from the environment.

It is to be understood that the present invention is not limited to the embodiments described above, but encompasses any and all embodiments within the scope of the following claims.

I claim:

1. An ashtray for use in a sandy environment comprising:

a receptacle having a generally conical wall;

a plurality of elongated blades disposed in elongated openings formed in said generally conical wall serving as a filling means to cause said receptacle to substantially fill with a supporting substrate, comprising sand, by virtue of said elongated blades when said ashtray is engaged with the supporting substrate, whereby:

the external pressure of the supporting substrate exerted against said generally conical wall during an initial insertion of said ashtray into the supporting substrate pushes said elongated blades into a sufficient angle and opening to channel the sand into a lower portion of said receptacle as said ashtray is twisted in a direction of leading edges of said elongated blades; and a bottom opening, whereby: said bottom opening is shaped from a plurality of generally angular blades at the bottom of said generally conical wall thus providing a loosening means to cause compact supporting substrate to substantially loosen as said ashtray is maneuvered in a downward twisting motion thereby engaging said generally angular blades into the compact supporting substrate and allowing sufficient penetration of the said ashtray into the supporting substrate.

2. The ashtray according to claim 1, wherein said elongated openings disposed in said generally conical wall are of a slightly smaller distance from one edge of said elongated opening to the opposite edge of said elongated opening than the distance of the diameter of a cigarette and, wherein said bottom opening of said generally conical wall is of a slightly smaller distance from one edge of said bottom opening to the opposite edge of said bottom opening, as defined along the outer perimeter of said bottom angular blades, than the distance of the diameter of a cigarette thereby allowing cigarette butts and other large particles of waste to be retained within said receptacle while allowing sand and ash to escape through said elongated openings and said bottom opening when the said ashtray is lifted from the supporting substrate.

3. The ashtray according to claim 1, wherein a plurality of wall supports adjoin an upper portion of said generally conical wall to the bottom portion of said generally conical wall thereby providing sufficient structure and support to allow said elongated blades to open and close and for said ashtray to be inserted and twisted into the supporting substrate.

4. The ashtray according to claim 1, wherein a lid comprised of a plurality of flexible lid tabs form a lid opening to receive extinguished cigarettes and other waste into said receptacle, and wherein said lid is attached to said generally conical wall by a lid attachment strap thereby allowing said lid to be inserted into said receptacle and snapped into wall supports.

5. The ashtray according to claim 4, wherein said lid when inserted and snapped into said generally conical wall limits the distance said elongated blades disposed in said generally conical wall can open inwardly towards the center of said receptacle thereby serving as a blade stop means to maintain an optimal angle of said elongated blades against the surrounding sand to cause said receptacle to fill with sand when said ashtray is inserted and twisted into the supporting substrate.

6. The ashtray according to claim 1, wherein an upper portion of said generally conical wall further includes at least one partial recess, said partial recess having a upper recess distance that is slightly larger than that of the diameter of a cigarette and a lower recess distance that is slightly smaller than that of the diameter of a cigarette to cause a cigarette to become pinched into the said partial recess once inserted and to be held securely within the upper portion of said receptacle.

7. The ashtray according to claim 1, wherein retrieval of said ashtray is provided by a lid opening and said bottom opening and a retrieval means for retrieving multiple said ashtrays from the environment, whereby:

said lid opening and said bottom opening are vertically aligned to allow for insertion of any rod shaped instrument with a diameter being slightly larger than that of said lid opening and said bottom opening causing lid tabs that form said lid opening and said generally angular blades that form said bottom opening to grasp a rod shaped retrieval instrument when inserted through the middle of said receptacle.

* * * * *